United States Patent [19]

Gorham

[11] 3,952,878

[45] Apr. 27, 1976

[54] GUN STAND

[76] Inventor: Jack R. Gorham, 3966 Lugo Ave., Lynwood, Calif. 90262

[22] Filed: Feb. 18, 1975

[21] Appl. No.: 550,758

[52] U.S. Cl. ..... 211/64; 248/156; 248/161; 52/155

[51] Int. Cl.[2] ..... A47F 7/00

[58] Field of Search ..... 211/60 R, 60 SK, 64, 211/1.3, 103, 65, 175–178; 248/DIG. 7, 156, 121, 122, 125, 127, 146, 149, 150, 158, 161, 159, 157; 52/155, 165

[56] References Cited

UNITED STATES PATENTS

| | | | |
|---|---|---|---|
| 1,373,560 | 4/1921 | Holland | 248/156 X |
| 2,158,623 | 5/1939 | Fischbacher | 211/64 |
| 2,738,941 | 3/1956 | Laurich et al. | 248/156 X |
| 2,869,729 | 1/1959 | Hayden | 211/64 |
| 3,007,581 | 11/1961 | Moore | 211/64 |
| 3,225,734 | 12/1965 | Bule | 248/156 X |
| 3,285,554 | 11/1966 | Voelkerding | 248/121 |
| 3,519,234 | 7/1970 | Matson | 248/156 |

*Primary Examiner*—Roy D. Frazier
*Assistant Examiner*—Terrell P. Lewis
*Attorney, Agent, or Firm*—Georges A. Maxwell

[57] ABSTRACT

A portable, light-weight, earth engageable gun rack adapted, when in use, to safely, effectively and dependably support a brace of two rifles or shot guns in ready to engage and use position and which, when not in use, can be collapsed and folded into a small, neat, convenient to carry package-like unit. When in use, the rack has major dimensions of approximately 40 inches × 7 inches × 7 inches and when collapsed and folded has dimensions of approximately 18 inches × 7 inches × 2 inches.

6 Claims, 8 Drawing Figures

GUN STAND

This invention has to do with a gun rack and is more particularly concerned with an improved, collapsible gun rack suitable for field use.

In the sport of hunting, particularly in the sport of hunting water fowl, such as duck or geese, it is common practice to use guns, i.e., shot guns. Further, in the hunting of water fowl with shot guns, it is generally necessary and is common practice for the hunter to situate himself, with his gun in hand, in some appropriate location in desired proximity to an area where the arrival of the hunted fowl is anticipated, and to quietly await the arrival of the fowl, whereupon he utilizes the gun to shoot or down the fowl.

It is not uncommon that the fowl hunter, in the situation briefly described above, must sit quietly for protracted periods of time, with his gun in hand so as to maintain it clean and dry or safe from the elements of the environment which might otherwise fowl it.

The ordinary shot gun which is used to hunt fowl is in excess of 3 feet long and weights in the neighborhood of 4 to 5 pounds. While such guns are designed to be comfortable and well balanced when in firing position or use, they are not favorably balanced or comfortable to hand-hold and support in still position or in any other manner for protacted periods of time.

The holding and supporting of shot guns in the field, while awaiting the arrival of the game or fowl, frequently causes the average hunter considerable fatigue and discomfort. In efforts to avoid such fatigue and discomfort, it has been rather common practice for the hunters to construct hideouts or blinds in which they can more comfortably wait and to build gun racks in the blinds to hold and support the shot guns for future convenient access and use.

Complicating or compounding the problems of holding shot guns in the field, as noted above, is the practice of hunters to carry more than one gun. The ordinary water fowl hunter is commonly equipped with and carries two shot guns, of different gauge. One such gun is ordinarily a small gauge or light gun to shoot fowl which come close to the hunters site and the other is a large gauge or heavy gun suitable to shoot fowl at a more distinct range or far from the hunter's site.

The above practice of carrying two guns materially increases the above noted adverse effects experienced by those hunters who must keep and support their guns in hand.

An object and feature of my invention is to provide a light weight, neat, compact, ground engaging gun rack which is particularly suitable for use by the water fowl hunter, in the field, to engage and support a brace or pair of shot guns in an effective and convenient disposition for immediate manual engagement and use, as circumstances require.

It is an object and feature of my invention to provide a gun rack of the character referred to which is such that it can be easily and quickly folded and collapsed to provide a small light weight, neat package-like unit which is easy and convenient to carry and transport.

It is to be noted at this time that the provision of a portable, ground engaging gun rack is not new, however, to the best of my knowledge, all such racks provided by the prior art have been elongate, rigid, heavy structures with undesirable and dangerous projecting parts or elements which have made them so awkward, inconvenient and undesirable to use that they have met with little or no favor with the overwhelming majority of hunters.

In regard to the above, when it is considered that the hunter, upon entering and advancing through the hunting field, is carrying two costly and finely detailed shot guns, each of which is over three feet long and weights about five pounds, it can be readily seen and appreciated that he will not favorable consider carrying a relatively rough metal rack of greater length and weight and which is repleat with sharp corners, etc., and in bundled relationship with his guns.

The above is particularly true when the need for and use of a gun rack may not and frequently is not needed. The need for such a rack is not needed when the arrival of the game need not be waited for, or when the hunter is favored with a site having some material structural features which will serve the purpose of a gun rack.

The above leads to the apparent need for a collapsible and/or foldable, light-weight and neat gun rack which is such that it can be made into a sufficiently small package that it can be conveniently confortably engaged and supported on and by an item of a hunter's clothing, such as a belt, and thereby made available for use whenever desired or as circumstances require.

Finally, it is a general object and feature of the present invention to provide a gun rack of the character referred to which is easy and economical to make and which is both effective and durable in use.

The foregoing and other objects and features of may invention will be fully understood from the following detailed description of a typical preferred form and embodiment of my invention, throughout which description reference is made to the accompanying drawing, in which.

Figures 1, 2, 3, 4, 5, 6, 7, 8:
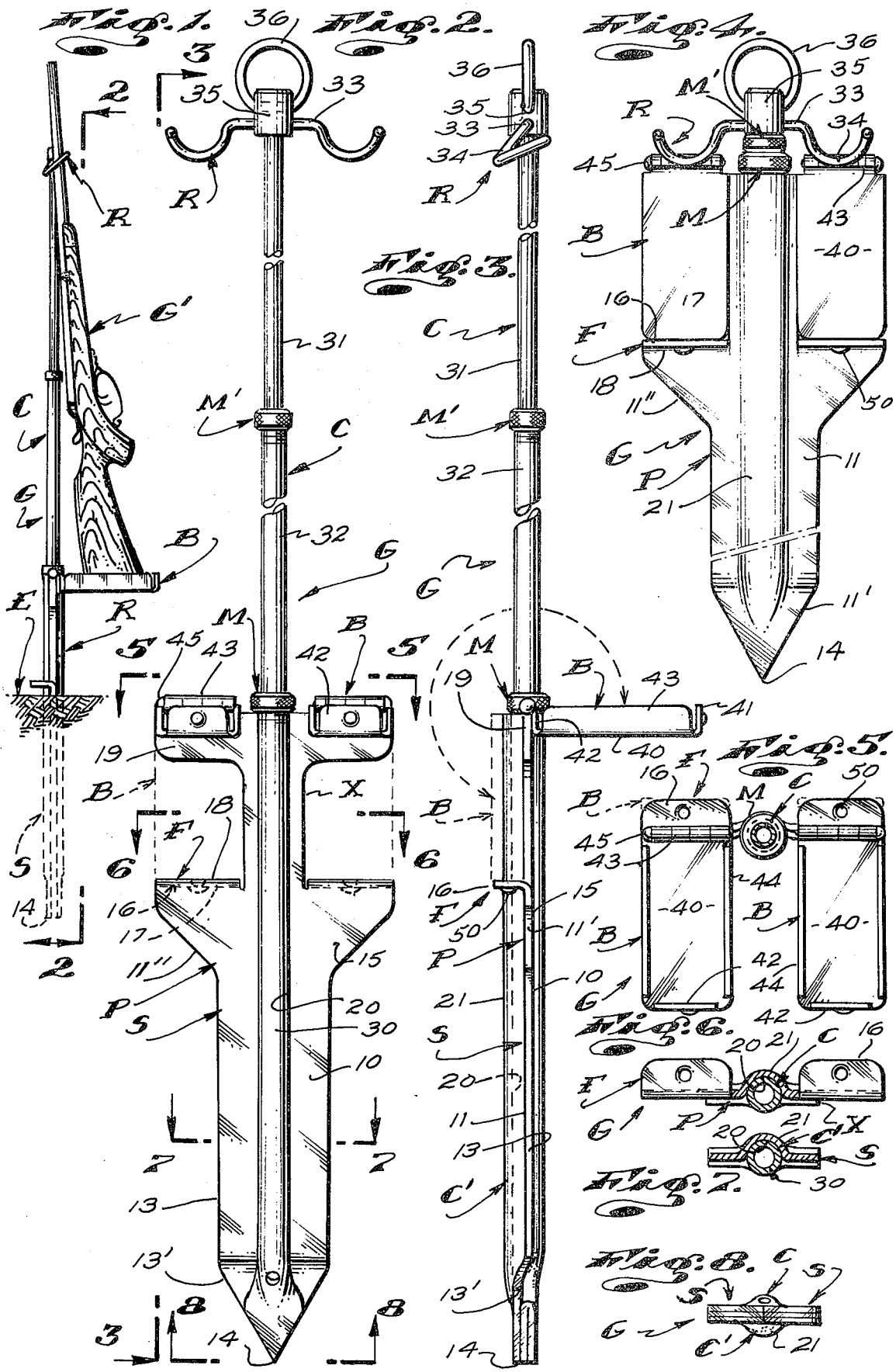
FIG. 1 is an elevational view of my new gun rack, in use.
FIG. 2 is an enlarged view of my new gun rack taken substantially as indicated by line 2—2 on FIG. 1.
FIG. 3 is a view taken as indicated by line 3—3 on FIG. 2.
FIG. 4 is a view showing my new gun rack in a collapsed and folded condition.
FIG. 5 is a view taken as indicated by line 5—5 on FIG. 2.
FIG. 6 is a view taken as indicated by line 6—6 on FIG. 2.
FIG. 7 is a view taken as indicated by line 7—7 on FIG. 2.
FIG. 8 is a view taken as indicated by line 8—8 on FIG. 2.

Referring to the drawing, in FIG. 1 thereof I have shown my new gun rack R in an open or unfolded and expanded position; engaged in the ground or earth E and supporting and carrying a shot gun G. In FIG. 4 of the drawings, I have shown my new gun rack R in a closed or folded and collapsed position and conditioned for manual transport and/or storage.

The rack R that I provide is an elongate vertical assemblage or construction having and/or defining the following basic means; lower ground or earth engaging means S; central foot supporting means F; intermediate butt support means B; and, upper barrel rest means R.

In addition to the above basic means and defining and/or cooperating to define and to carry or support those means is a substantially flat, rigid plate-like frame or body P and an elongate, central, vertical and axially extensible column C.

The plate P is a flat, vertically extending unit, preferably formed of sheet metal and is characterized by an elongate, vertical lower portion or spike 10.

The spike 10 is of limited lateral extent, has flat front and rear surfaces 11 and 12, vertical side edges 13, the lower end portions 13' of which are angularly disposed to converge toward the central vertical axis of the spike and of the plate to define a sharp point 14 at the lower terminal end of the spike 10. The upper end portions 13'' of the side edges 13 of the spike 10 are angularly disposed to diverge laterlly outward relative to the axis of the plate and define an upper stabilizer portion 15 on the spike, greater in lateral extent than the remainder thereof. The spike 10 establishes the earth engaging means S and is adapted to be forced and urged downwardly into engagement with and in the earth, as shown in FIG. 1 of the drawings. The point 14 assures easy entry of the spike into the earth. The limited laternal extent of the central portion of the spike 10 assures easy penetration of the major longitudinal extent of the spike through and into the earth, by reduction of the amount of earth that must be displaced by the spike and so that lateral stability of the rack in and relative to the earth is assured. The upper stabilizer portion 15, with its inclined edges 11'' is the last portion of the spike to engage in the earth as the spike is urged downwardly therein and serves to afford rotary stability to the rack. That is, it prevents the rack from rotating about its axis, relative to the earth.

In addition to the foregoing, and establishing a part of the means S and also a part of the means F, as will hereinafter be described, is a pair of horizontal laterally extending and rearwardly projecting flanges 16 at and along the upper edges of the stabilizer portion 15 of the spike and laterally spaced, to occur at opposite sides of the central vertical axis or central vertical portion of the plate. The flanges 16 serve to reinforce the portion 15, define downwardly disposed, flat, earth engaging stop surface 17 and flat, upwardly diposed foot engaging surfaces 18. The surfaces 17 engage the earth surface to limit penetration of the spike in the earth and stagbilize or support the rack from lateral tipping and/or displacement.

The earth and foot engaging flanges 16 are formed integrally with the plate by a simple cutting or shirring and binding operation.

The portions of the plate occurring above the flanges and at opposite sides of the central vertical axes and/or portion of the plate are relieved, as at X to provide toe space for the foot or shoe of the user of the rack whereby his foot or shoe can be conveniently engaged on the top foot engaging surfaces 18 of the flanges. The noted relieved portions or laterally, forwardly and rearwardly opening recesses defined thereof and the flanges 16, particularly the top foot engaging surfaces 18 thereof, define the central foot support means F.

The upper terminal portion of the plate P, above the relieved portions or recesses X has a substantially straight horizontal upper edge, the portions of which, occurring at the opposite sides of the central portion of the plate, are formed to establish portions of hinge means H. This is, the edges are formed with spaced circular hinge pin engaging sleeves, whereby the upper side portions of the plate P define laterally outwardly projecting, flat, vertical hinge plates 19 integral with the central portion of the plate.

Finally, the plate P is characterized by a central, forwardly opening column receiving semi-circular channel 20, substantially coextensive with the central vertical portion of the plate and preferably concentric with the central vertical axis of said plate. The channel 20 is defined by a longitudinal semi-circular reinforcing rib 21 found in and projecting rearwardly from the rear surface 11 of the plate.

It will be apparent that the plate P described above is a simple and economical to manufacture part and is such that it is light-weight, small and yet rugged and durable.

The column C that I provide is an elongate vertical, assemblage made up of two or more telescopically engaged metal tube sections. In the case illustrated, I have shown the column C comprising three tube sections, there being a lower or outer tube section 30, a central or upper inside tube section 31 and an intermediate tube inside section 32.

The lower outer tube section 30 is substantially coextensive with the vertical extent of the plate, corresponds in outside diameter with the channel 20 and is seated and fixed in said channel, as by welding.

In practice, and as shown in the drawing, the lower terminal end of the tube 30 is flattened to be flat across the pointed lower end portion 14 of the plate spike, is fixed to the plate as by spot welding and is formed with convergent edges and a point, regstering with the edges 11' and point 14 of the spike, whereby the point and portion of the spike is effectively reinforced by the tube section 30.

The upper terminal end portion of the section 30 projects a limited distance above the upper edge of the plate and is provided with collet-chuck type gripping or locking means M to releasably grip about and hold the intermediate tube section 32. The means M is preferably that well-known form of gripping means comprising a manually engageable clamp ring with tapered internal threads engaged about the exterior of a slotted end portion of a tube section and adapted to yieldingly urge the segments of the tube section defined by the slots therein, inwardly into clamping engagement with a part within the tube.

In practice, if desired, the means M can be in the form of a manually engageable pin and spaced and registerable pin receiving openings in the related tube sections or can be that form of stop means comprising spring loaded latch members and cooperating recesses or apertures, without departing from the spirit of my invention.

The intermediate tube section 32 is substantially equal in longitudinal extent with the section 30; is slidably engaged in the section 30; slidably receives the section 31 and is provided with gripping or loading means M', similar to the means M, at its upper end to engage and grip the section 31.

The inner section 31 is substantially equal in longitudinal extent with the section 31; is slidably engaged in the section 31 and is provided at its upper end with a laterally extending, horizontal yoke 33 defining the rest means R. The yoke 33 is shown as established of bent or formed metal rod and has opposite end portions projecting laterally from opposite sides of the section 31 and defining vertically and forwardly opening, substantially semi-circular gun barrel engaging hook-like rests 34.

In the case illustrated, the yoke is carried by a cylindrical head 33 fixed to the upper end of the section 31 and which carries a carrier ring 36 to facilitate releasably hanging the rack on a hook or the like on the user's belt, or in a storage area, as desired, or as circumstances require.

It is to be noted and understood that the section 31 could be established of solid rod stock. Further, it is to be understood that the section 32 could be eliminated, in which case the column C would be a two section unit. The number of sections establishing the column C is determined by the vertical extent of the body or plate P and the style and length of the guns the rack is designed to support.

Next and finally, the rack that I provide includes the butt rest means B which means include a pair of laterally spaced gun butt receiving trays 40 pivotally carried by the upper edge of the plate P. When in use, the trays project horizontally forwardly from the plate in vertical and forward spaced relationship below related barrel hooks or rests 34 of the means R. The rests or trays 40, when disposed as set forth above, are characterized by flat, horizontal bottom walls 41, rectangular in plane configuration and flat vertical front, rear and side walls or flanges 42, 43 and 44.

The rear walls or flanges 43 of the trays 40 have upper edge portions formed with laterally spaced hinge pin receiving rings or sleeves to cooperate with the similar rings on their related upper edges of the plate P and so the the walls 43 are, in effect, vertical hinge plates at the rear ends of the trays.

The hinge plates 43, as shown in the drawings, are pinned with the flat, vertical hinge plates 19 defined by the plate by the pins 45 and, when the rack is in use, establish flat, bearing, stopped engagement on and with the forward sides or surfaces of the hinge plates 19 whereby the trays are supported in their noted forwardly projecting, horizontal and upwardly opening dispositions.

While the trays 40 might be formed as by suitably drawing the stock from which they are made and while they might be made aesthetically more pleasing, the form in which they are shown lends to easy and economical manufacture.

Further, in practice, it is desired that the corners of the trays be opened, as shown, to assure drainage of water and the convenient displacement of dirt and foreign water from the trays when the rack is in use.

With the structure set forth above, when the rack is in use, as shown in FIG. 1 of the drawings, the butts of guns are engaged and seated in the trays 40 of the means B and the barrels are disposed to extend upwardly and are inclined rearwardly to engage and rest in the hooks of the means R. It will be apparent that the gun G or guns thus related to the rack (engaged with the earth) are effectively supported in a safe and convenient to engage for use manner.

In furtherance of the present invention, the vertical extent between the foot engaging flanges 16 of the means F and the pivotal axes of the trays of the means B is substantially equal to the fore and aft dimension or length of the trays and such that when the trays are pivoted upwardly, rearwardly and thence downwardly from the normal use position to a folded position, where they are vertically disposed and occur in stopped engagement against the rear surface of the plate. As shown in FIG. 4 of the drawings, and in dotted lines in FIGS. 2, 3 and 5 of the drawings, the front walls or flanges 42 of the trays slidably engage and stop in adjacent opposing relationship with their related foot engaging flanges 16.

In practice, for example, the trays are 6 inches long and 1 inch deep. When in their open or horizontal use position, the dimensions of the rack, fore and aft, are 6 inches plus the thickness of the fore and aft dimensions of the plate and column, which is, for example, 1 inch making the total fore and aft dimension of the rack 7 inches. It will be apparent from the foregoing, when the trays are in the folded position, as shown in FIG. 4 of the drawings, the fore and aft dimensons of the rack is reduced from 7 to 2 inches and that the vertical extent or dimensions of the plate P is not altered.

In practice, and to yieldingly releasably maintain the trays down in the folded position, the walls 41 and flanges 16 are provided with registerable projection and detent type stop means 50, as clearly shown in the drawings.

When the rack is put or placed out of use and after the trays are pivoted down in folded relationship with the plate P, means M and M′ are released and the column C is collapsed vertically downwardly to bring the hooks 34 of the means R into stopped bearing engagement with the rear walls or hinge plates 43 of their related trays 40. The means M and M′ are then tightened to secure the column in its collapsed condition and so that the hooks serve to hold the trays in their folded or down positions, as clearly shown in FIg. 4 of the drawings.

In practice, for example, the vertical extent of the plate P can be from 18 to 20 inches and the effective vertical extent of the tube section 31 and 32 can be from 15 to 16 inches. With these dimensions, the vertical extent of the spike can be at least 12 inches, the vertical distance between the butt rest trays and barrel rest hooks can be from 30 inches to 32 inches and the overall vertical extent of the rack can be approximately 40 inches when in use and 18 to 20 inches when folded and collapsed for transport and storage. The lateral extent of the rack can be approximately 7 inches. This dimension allows for the central portion of the plate P being about 1½ inches and for the butt rest trays being 3 inches wide.

It will be apparent that the rack, when opened, expanded and in condition for use, is a large, expansive structure, the outside dimensions of which are about 40 inches by 7 inches by 7 inches, and that when folded and collapsed for transport and storage is small and compact with outside dimensions of about 18 inches by 7 inches by 2 inches.

A common gun safety law which has become substantially uniform throughout the U.S. prohibits the engaging and supporting or resting of fireharms (rifles) on or against vehicles. This law recognizes the fact that when rifles are rested on vehicles and persons enter and exit the vehicles, causing the vehicles to move, the rifles are caused to shift out of supported engagement with the vehicles, drop to the ground and to frequently accidentally discharge, creating a condition of extreme hazard. The noted law, which carries with it a substantial fine is intended to eliminate or reduce the noted hazard.

It will be apparent that the gun rack that I provide is particularly adapted to be put into use in close proximity to vehicles used by hunters and the like, whereby the hunters, when loading or unloading their vehicles and moving about the site of the vehicles, can conveniently rack their rifles in a safe location, remote from their vehicles, avoid breaking the above noted law and, more important, avoid the hazard that law is designed to protect people against.

It will be apparent that the rack that I provide is effective to support two guns, is easy and economical to make, is easy and convenient to use, is a safe, rugged and durable construction.

Having described only one preferred form and application of my invention, I do not wish to be limited to the specific details herein set forth but wish to reserve to myself any modifications or variations which may appear to those skilled in the art and which fall within the scope of the following claims.

Having described my invention, I claim:

1. A folding collapsible earth engaging gun rack comprising an elongate vertical plate with front and rear surfaces and having a central elongate, vertical, earth engaging lower spike portion of limited lateral extent with a downwardly convergent pointed lower end, laterally spaced laterally outwardly and rearwardly projecting horizontal flanges with lower earth engaging surfaces and upper foot engaging surface at the upper end and at opposite sides of the spike portion and laterally outwardly projecting flat vertical hinge plates in vertical spaced relationship above the flanges, laterally spaced elongate normally horizontally disposed forwardly projecting gun butt receiving trays with inner and outer ends and normally vertical hinge plates at their rear ends with upper edges pivotally connected with upper edges of related hinge plates of said plate and normally establishing flat, stopped bearing engagement on the said related hinge plates, said trays being pivotally shiftable upwardly rearwardly and downwardly to a folded vertical position at the rear of the plate with their outer ends adjacent to and opposing said flanges related thereto, an elongate vertically extending column having an elongate outer upwardly opening lower tube section substantially coextensive with and fixed to and extending longitudinally of the central vertical axis of the plate, an elongate vertical inner tube section telescopically engaged in the outer tube and normally projecting upwardly therefrom, a yoke at the upper end of the inner tube and defining laterally spaced laterally outwardly projecting vertically and forwardly opening gun barrel engaging hooks normally spaced above and rearward of the trays, and releasable lock means between said tube sections, said inner tube sections being shiftable downwardly to a collapsed position within the outer section where said hooks engage the hinge plates of the trays when said trays are in said folded position.

2. The structure set forth in claim 1 wherein said plate has a central vertical reinforcing rib formed therein defining a central longitudinal recess, said outer tube being arranged and fixed in seated engagement in said recess.

3. The structure set forth in claim 2 wherein said column includes lock means to releasably hold the inner and outer sections in desired related longitudinal position.

4. the structure as set forth in claim 3 wherein said lock means comprises circumferentially spaced longitudinal slots in the upper end portion of the outer tube, a manually engageable ring with tapered internal threads engaged about said upper end portion and operable to urge the said upper end portion into gripping engagement with the inner tube portion.

5. The structure set forth in claim 1 wherein said column includes lock means to releasably hold the inner and outer sections in desired related longitudinal position.

6. The structure as set forth in claim 5 wherein said lock means comprises circumferentially spaced longitudinal slots in the upper end portion of the outer tube, a manually engageable ring with tapered internal threads engaged about said upper end portion and operable to urge the said upper end portion into gripping engagement with the inner tube portion.

* * * * *